US006257410B1

(12) United States Patent
Ulmann et al.

(10) Patent No.: US 6,257,410 B1
(45) **Date of Patent: *Jul. 10, 2001**

(54) DISPENSABLE PRODUCTS HAVING END-WISE INDICIA

(75) Inventors: Corinne Celia Ulmann, Cincinnati; Paul Dennis Trokhan, Hamilton, both of OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/364,796

(22) Filed: Jul. 30, 1999

(51) Int. Cl.[7] ..... B32B 3/00

(52) U.S. Cl. ..... 206/389; 40/360; 206/457; 206/459.5; 242/160.1; 242/912; 428/37; 428/906

(58) Field of Search ..... 40/305, 360; 116/200, 116/201; 206/389, 459.1, 459.5, 457; 242/160.1, 912; 283/117; 428/37, 906, 350; 101/127

(56) References Cited

U.S. PATENT DOCUMENTS

| | | | | |
|---|---|---|---|---|
| 610,339 | * | 9/1898 | Atherton | 206/389 |
| 1,481,864 | * | 1/1924 | Golding | 206/459.5 |
| 2,215,052 | * | 9/1940 | Price et al. | 225/54 |
| 2,303,144 | * | 11/1942 | Stephenson | 428/906 |
| 2,383,637 | * | 8/1945 | Yates | 206/459.5 |
| 2,780,352 | * | 2/1957 | Schroeder | 428/906 |
| 3,648,835 | * | 3/1972 | Yucel | 206/459.5 |
| 4,238,541 | * | 12/1980 | Burton | 428/906 |
| 4,427,290 | * | 1/1984 | Kaye et al. | 283/117 |
| 4,901,663 | * | 2/1990 | De Luca | 428/906 |
| 4,915,316 | | 4/1990 | Bastian . | |
| 5,123,343 | | 6/1992 | Willer . | |
| 5,135,134 | | 8/1992 | Dancy | 221/61 |
| 5,209,953 | | 5/1993 | Grupe et al. . | |
| 5,339,730 | | 8/1994 | Ruppel et al. . | |
| 5,490,457 | | 2/1996 | Boulanger et al. . | |
| 5,520,112 | | 5/1996 | Schleinz et al. . | |
| 5,526,748 | | 6/1996 | Schleinz et al. . | |
| 5,566,616 | | 10/1996 | Schleinz et al. . | |
| 5,567,514 | * | 10/1996 | Gold | 428/350 |
| 5,573,593 | | 11/1996 | Sutton . | |
| 5,597,642 | | 1/1997 | Schleinz et al. . | |
| 5,799,577 | * | 9/1998 | Takahashi | 101/127 |

FOREIGN PATENT DOCUMENTS

| | | | |
|---|---|---|---|
| 0 414 015 A2 | 2/1991 | (EP) . | |
| 0635375A2 | 1/1995 | (EP) | B41J/3/407 |
| 63-237970 | 10/1988 | (JP) | B41J/15/00 |
| WO 95/15410 | 6/1995 | (WO) . | |
| WO 98/37794 | 9/1998 | (WO) . | |

* cited by examiner

*Primary Examiner*—Jim Foster
(74) *Attorney, Agent, or Firm*—Larry L. Huston; Julia A. Glazer; Tara M. Rosnell

(57) ABSTRACT

A spiral wound product having indicia thereon. The indicia are disposed on the ends of the product, resulting in less ink usage while providing a functional benefit or an aesthetically-pleasing pattern which can last for the life of the product. Optionally, indicia may be applied to the XY surface of the product as well. The invention is applicable to paper products dispensed from a core, as well as coreless spiral wound paper products. This invention is also applicable to cut-and-stack configurations where the product may be dispensed from a package. The product may be dispensed from the package in either a reach-in or pop-up mode.

2 Claims, 1 Drawing Sheet

DISPENSABLE PRODUCTS HAVING END-WISE INDICIA

FIELD OF THE INVENTION

This invention relates to paper products wound into a spiral to form a generally cylindrical shape, and more particularly to such paper products which are provided with indicia.

BACKGROUND OF THE INVENTION

Dispensable products are well known in the art. Dispensable products include any product, provided in sheet form and from which a portion can be removed for ultimate use by the consumer. Dispensable products include, but are not limited to nonwoven wipes, dryer-added fabric softeners, notebook paper, wet wipes, food wrap and tissue.

Tissue products are well known in the art. Tissue products may be used as facial tissue, bath tissue, paper toweling, napkins, placemats, etc. The tissue products are often spiral wound, particularly when used for bath tissue or paper towel products. However, this invention is applicable to any spiral wound product. Other and nonlimiting types of spiral wound products include dryer-added fabric softeners, nonwoven wipes, and pressure-activatable sealing wrap.

Tissue products are also dispensed from a cut-and-stack configuration, particularly when used for facial tissue or table napkins. Cut-and-stack products may be dispensed from a package wherein one tissue product is successfully removed through a dispensing aperture. The packages are typically provided with aesthetically pleasing indicia in a variety of formats. The consumers then select the aesthetically pleasing indicia which most closely aligns with their personal tastes and/or decor.

The dispensable product is typically divided into a plurality of individual sheets by transverse perforations. One or more sheets is removed from the roll. Each sheet defines an XY plane and a Z-direction orthogonal to the XY plane. The XY plane contains the printed indicia according to the prior art.

It is often desirable to provide indicia on such spiral wound or other dispensable products. The indicia may be provided to improve the aesthetics of the product, provide instructions to the user, etc.

Typically, the indicia are applied by printing ink onto the substrate. However, printing ink onto an exposed surface of the substrate comes with certain drawbacks. As more of the surface becomes covered with indicia, manufacturing costs increase. Some consumers prefer only a slight accent of the ink, rather than large aesthetic patterns. Some cultures have an aversion to allowing noticeable quantities of ink to touch food or food preparation surfaces. Additionally, as the quantity of ink printed onto the product increases, a proportionate amount of bleeding onto countertops may occur during use.

One attempt in the art to provide indicia to towel dispensers was disclosed in U.S. Pat. No. 4,915,316, issued Apr. 10, 1990 to Bastian, which provides a paper roll holder, the decoration of which is said to be easily changed. However, this has the drawback that the indicia are not found on the actual product. Yet another attempt is found in WO 98/37794 A1 in the names of Kessler et al.

It is apparent that neither of the foregoing meets the need for reduced ink consumption while providing aesthetics which last throughout the life of a dispensable paper product. It is further apparent that what is needed in the art is an inexpensive way to provide indicia while reducing the likelihood of the indicia contaminating food or bleeding onto countertops.

SUMMARY OF THE INVENTION

Referring to FIGS. 1 and 2, the invention comprises a dispensable product. The dispensable product comprises a substrate. The substrate defines an XY plane and a Z-direction orthogonal to the XY plane. The substrate is arranged in a packagable configuration. The packagable configuration has a dispensing direction in which a portion of the substrate is removed from the balance of the dispensable product. The dispensable product has at least one end, and typically at least two oppositely-disposed ends, generally perpendicular to the dispensing direction. At least one of the two oppositely-disposed ends, and frequently both, have indicia disposed thereon.

In one configuration, the dispensable product is spiral wound. If a spiral wound dispensing configuration is selected, the product may be wound about a core or may be spiral wound in a coreless manner. The spiral wound configuration is typically, but not necessarily, dispensed directly from a spindle inserted into the core of the product or open center of a coreless product. This arrangement obviates the need for external packaging.

A core-wound dispensable product, and a coreless dispensable product, may be provided in a generally cylindrical configuration having a round cross-section. Alternatively, either such spiral wound product may be diametrically compressed to conserve space during shipping and handling. The compressed dispensable product is then re-rounded at the point of use.

In another embodiment, the dispensable product may be provided in a cut-and-stack configuration. The cut-and-stack dispensable product is typically disposed in and dispensed from a package. The dispensable product may be removed from the dispensing container by either pop-up dispensing, by reach-in dispensing, or by a combination thereof.

Without regard to whether the dispensable product is provided in a spiral wound configuration or a cut-and-stack configuration, the substrate may comprise various materials or combinations of materials, including cellulosic fibers. The substrate may be of indeterminate length, may be divisible into individual sheets, or may be already divided into individual sheets.

The indicia may be aesthetic or functional. Aesthetic indicia provide for and preferably improve the visual appearance of the dispensable product. Functional indicia impart a benefit not limited to the aesthetics of the product.

DETAILED DESCRIPTION OF THE INVENTION

Figure 1:
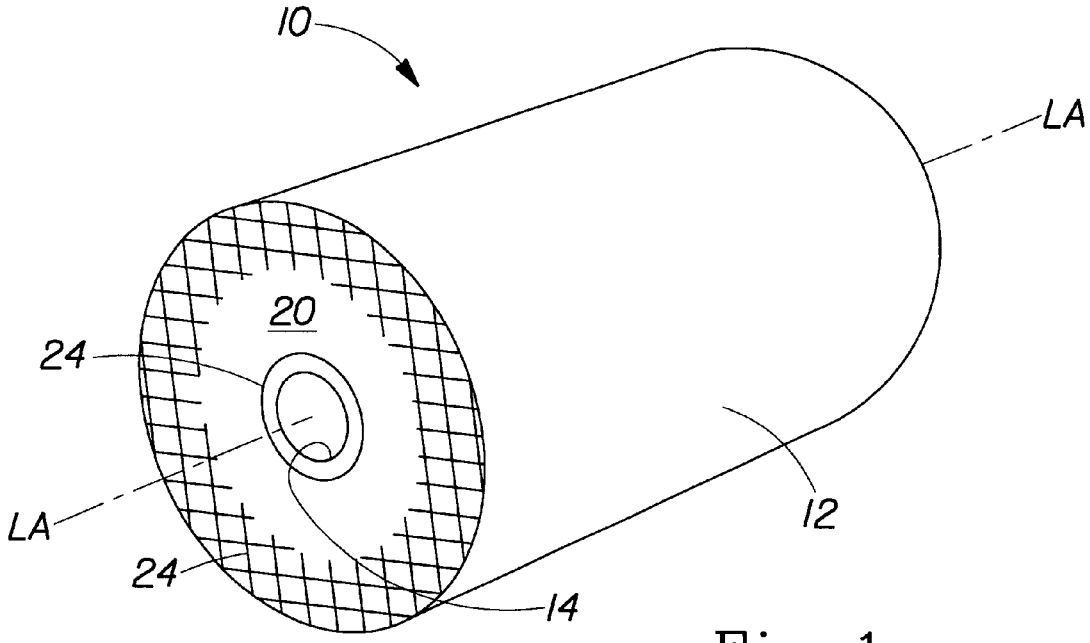
FIG. 1 is a perspective view of a first spiral wound paper product according to the present invention.

The present invention comprises a dispensable product 10 disposed in a dispensable configuration. The dispensable configuration may be spiral wound. The dispensable product 10 comprises a substrate 12 disposed in a spiral wound configuration.

Spiral wound products 10 are known in the art. Typically, the spiral wound product 10 comprises a substrate 12 wound about a core 14, although coreless products 10 are contemplated to be within the scope of the invention. The product 10 forms a generally round cylinder having two oppositely-disposed and defined ends 20. The spiral wound product 10 will be described below as a paper product 10, such as bath tissue or paper toweling, but it is to be recognized the invention is not so limited. The paper product 10 is preferably divisible into individual sheets separable by transversely-oriented perforations, although products 10 of indeterminate length are contemplated.

The spiral wound paper product 10 is illustrated herein as a regular cylinder. A regular cylinder has first and second oppositely-disposed ends 20 perpendicular to a longitudinal axis LA coincident the center of the cylinder. However, it is to be recognized that the invention is not so limited. For example, the ends 20 of the paper product 10 may be disposed at an acute angle relative to the longitudinal axis LA. Any configuration having ends 20 with a vector component generally perpendicular to the dispensing direction is suitable. The dispensing direction is the direction in which one or more sheets of the substrate 12 are removed from the balance of the product 10.

The longitudinal edges of the paper product 10 may be scalloped, sinusoidal or of other irregular undulations which provide for a non-constant width in the cross machine direction. Alternatively, the transverse ends 20 of individual sheets, typically divided by perforations or other lines of weakness, need not be parallel to the longitudinal axis LA of the cylinder. Instead, the transverse ends 20 may have sinusoidal or other undulating shapes as known in the art, or may be diagonally skewed relative to the longitudinal axis LA.

Suitable cores 14 about which the paper product 10 may be spiral wound include commonly assigned U.S. Pat. No. 5,865,396 issued Feb. 2, 1999 to Ogg et al., U.S. Pat. No. 5,671,897 issued Sep. 30, 1997 to Ogg et al., both being incorporated herein by reference. If desired, the spiral wound paper product 10 may be used without a core 14. An adapter suitable for dispensing a spiral wound paper product 10 not having a core 14 is illustrated in commonly assigned U.S. Pat. No. 5,848,762 issued Dec. 15, 1998 to Reinheimer et al., incorporated herein by reference.

If desired, the spiral wound paper product 10 may be compressed to conserve space after manufacture. Paper products 10 which have been compressed for this purpose are illustrated in commonly assigned U.S. Pat. No. 5,027,582 issued Jul. 2, 1991 to Dearwester and U.S. Pat. No. 5,894,708 issued Apr. 13, 1999 to Newby et al., both incorporated herein by reference. Cores 14 suitable for use with compressed core 14 wound paper products 10 are illustrated in commonly assigned U.S. Pat. No. 5,255,865 issued Oct. 26, 1993 to Buell et al. and U.S. Pat. No. 5,318,235 issued Jun. 7, 1994 to Sato, both incorporated herein by reference. Compressed cores 14 may be opened with a spindle, such as disclosed in U.S. Pat. No. 5,277,375 issued Jan. 11, 1994 to Dearwester and incorporated herein by reference.

The substrate 12 used with the dispensable paper product 10 of the present invention may comprise cellulosic, synthetic fibers, a printable polyolefinic or other film, or a combination thereof. As noted above, the following description is given in conjunction with a core 14 wound paper product 10, although it is to be recognized that the invention is not so limited.

If desired, the core 14 wound paper product 10 may be conventionally dried using a press felt or through air dried. Suitable teachings illustrating ways to make the core 14 wound paper products 10 are illustrated by commonly assigned U.S. Pat. No. 4,529,480, issued Jul. 16, 1985 to Trokhan; U.S. Pat. No. 4,637,859, issued Jan. 20, 1987 to Trokhan; U.S. Pat. No. 5,364,504, issued Nov. 15, 1994 to Smurkoski et al.; U.S. Pat. No. 5,529,664, issued Jun. 25, 1996 to Trokhan et al.; U.S. Pat. No. 5,679,222 issued Oct. 21, 1997 to Rasch et al.; U.S. Pat. No. 5,714,041 issued Feb. 3, 1998 to Ayers et al.; U.S. Pat. No. 5,906,710, issued May 25, 1999 to Trokhan, the disclosures of which are incorporated herein by reference.

Other teachings for paper products 10 suitable for use with the present invention are found in U.S. Pat. Nos. 5,429,686 and 5,672,248. Yet other teachings which will yield a product 10 suitable for use with the present invention are found in commonly assigned U.S. Pat. No. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; U.S. Pat. No. 5,861,082 issued Jan. 19, 1999 to Ampulski et al., U.S. Pat. No. 5,871,887 issued Feb. 16, 1999 to Trokhan et al.; U.S. Pat. No. 5,897,745 issued Apr. 27, 1999 to Ampulski, et al.; U.S. Pat. No. 5,904,811 issued May 18, 1999 to Ampulski et al.; U.S. Pat. No. 3,301,746, issued Jan. 31, 1967 to Sanford et al.; U.S. Pat. No. 3,905,863, issued Sep. 16, 1975 to Ayers; U.S. Pat. No. 3,974,025, issued Aug. 10, 1976 to Ayers; U.S. Pat. No. 4,191,609, issued Mar. 4, 1980 to Trokhan; U.S. Pat. No. 4,239,065, issued Dec. 16, 1980 to Trokhan; U.S. Pat. No. 5,366,785 issued Nov. 22, 1994 to Sawdai; and U.S. Pat. No. 5,520,778, issued May 28, 1996 to Sawdai, the disclosures of which are incorporated herein by reference. Alternatively, the substrate 12 may comprise a nonwoven material, as is known in the art.

If desired, the substrate 12 may comprise a pressure-activatable film wrap instead of the aforementioned cellulosic materials. One such substrate 12 usable with the present invention comprises a three-dimensional, conformable web having an active substance such as adhesive on at least one surface and protected from external contact by the three-dimensional surface topography of the substrate 12. Such materials comprise a polymeric or other sheet material which is embossed/debossed to form a pattern of raised "dimples" on at least one surface which serve as stand-offs to prevent an adhesive therebetween from contacting external surfaces until the stand-offs are deformed to render the structure more two-dimensional. Representative substrates 12 include those disclosed in commonly assigned U.S. Pat. No. 5,662,758, issued Sep. 2, 1997 to Hamilton et al. and U.S. Pat. No. 5,871,607, issued Feb. 16, 1999 to Hamilton et al., both of which are incorporated herein by reference.

The indicia 24 may be provided by any means known in the art, including but not limited to cutting material from the ends 20 of the paper product 10 to remove material therefrom. Prophetically a laser-engraving technique could be used for this purpose. Alternatively, the indicia 24 may be provided by embossing patterns into the ends 20 of the paper product 10, extruding the indicia 24 onto the ends 20, spraying the indicia 24 onto the ends 20, applying the indicia 24 as thermal transfers, pressure activated transfers, and preferably printing.

If printing is selected, the indicia 24 may be provided by photocopying or by gravure, lithographic or flexographic printing. If printing is selected as the means for applying the indicia 24, the printing apparatus may be constructed according to the teachings of commonly assigned U.S. Pat. No. 5,213,037 issued May 25, 1993 to Leopardi, II. If desired, the apparatus may have reservoir baffles, as disclosed in commonly assigned U.S. Pat. No. 5,255,603 issued Oct. 26, 1993 Sonneville et al. If desired, the indicia 24 may be registered with perforations or drop off cuts, as disclosed in commonly assigned U.S. Pat. No. 5,802,974 issued Sep. 8, 1998 to McNeil. The disclosures of the three aforementioned patents are incorporated herein by reference.

Preferred aesthetic indicia 24, particularly applicable to printing, includes inks, as are well known in the art. Any commercially available ink suitable for epidermal contact and contact with food may be used for the aesthetic indicia 24 of the present invention. If desired, the inks may fluoresce or glow in the dark.

Printing may be accomplished as follows. The individual rolls are fed down a conveyor in a direction perpendicular to the longitudinal axis LA of the product 10. A print roll, rotatable about an axis perpendicular to both the longitudinal axis LA of the spiral wound product 10 and to the machine direction is provided for each end 20 of the product 10 desired to be printed. For example, if the conveyor is horizontally oriented, the longitudinal axis LA of the paper product 10 is coincident the machine direction. The print roll is therefore rotatable about a vertical axis. The print roll is phased so that the indicia 24 are applied from the print roll to the ends 20 of the product 10.

The print roll may be phased so that there is one repeat per flight of product 10 in the feed conveyor. Alternatively, the print roll may provide for a plurality of patterns in each revolution, but apply only a single pattern to each end 20 of the paper product 10. The conveyor is preferably juxtaposed with the discharge of the log saw.

According to the present invention, indicia 24 are applied to at least one, and preferably both ends 20 of the paper product 10. The indicia 24 may be the same on each of the two ends 20 of the paper product 10, or may be different. Differences may occur in the pattern selected, in the color, in the amount of the indicia 24 which is used, etc. Preferably, the indicia 24 comprise a color contrasting with the substrate 12, so that the indicia 24 are easily visible at a distance.

Suitable indicia 24 include any aesthetically pleasing pattern such as geometric shapes of FIG. 1, flowers, birds, any animals, or spiral patterns, holiday themes, seasonal themes, cartoons, advertising, trademarks, instructions for use, etc. If desired, the ends 20 of the product 10 may be completely coated with the indicia 24 to present a solid color different from that of the substrate 12 not having indicia 24. By providing the indicia 24 on the ends 20 of the paper product 10, it may be unnecessary to provide indicia 24 on the XY surface of the product 10. This allows for considerable conservation of ink reducing the aforementioned issues associated with having excessive amounts of ink printed on the XY surface of the substrate 12.

If desired, the XY surface of the substrate 12 may also be printed with ink or have other indicia 24 disposed thereon. If indicia 24 are applied to the XY surface of the substrate 12, preferably such indicia 24 are aesthetically coordinated with the indicia 24 disposed on at least one end 20 of the spiral wound product 10. For example, the end 20 of the paper product 10 could have vines and branches while the XY surface could have flowers and berries, the ends 20 of the product 10 could have small animals while the XY surface could have large animals, the ends 20 of the product 10 could have birds while the XY surface could have butterflies, etc. Alternatively, the end 20 of the paper product 10 could have indicia 24 provided in a first color while the XY surface could have like indicia 24 provided in a second or other different color.

The indicia 24 may be applied to either or both of the surfaces of the paper 20. The indicia 24 may cover all or part of the paper 20 and be applied in a continuous or discontinuous pattern.

Figure 2:
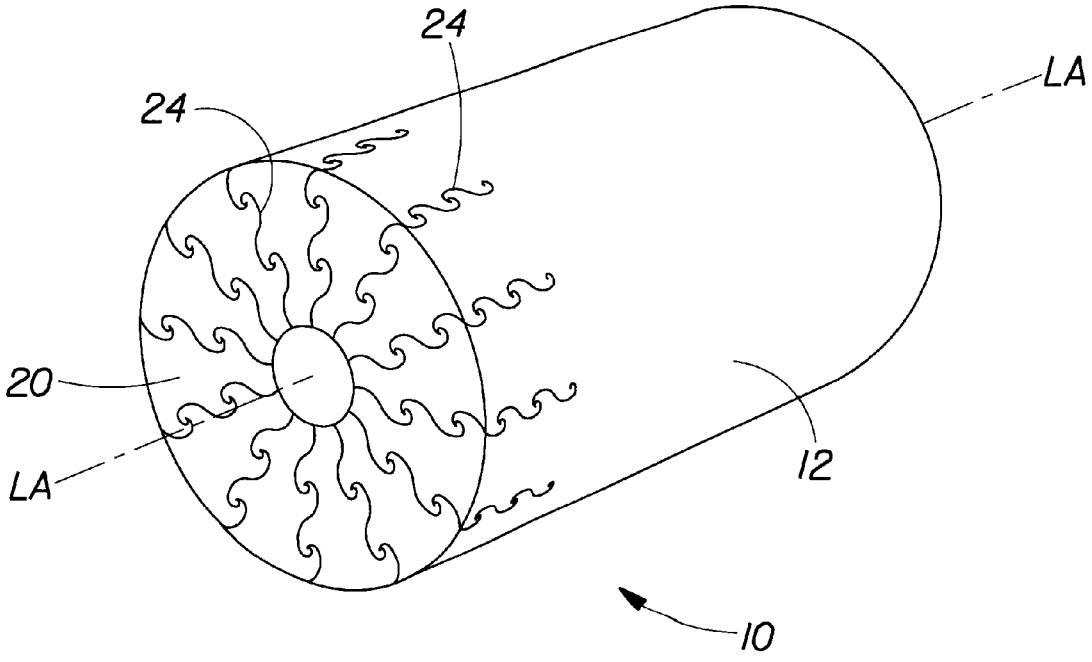
FIG. 2 is a perspective view of a second spiral wound paper product according to the present invention.

Referring to FIG. 2, a single indicium 24 or a plurality of indicia 24 may wrap the spiral wound paper product 10 from the XY surface to either or both ends 20. Such an indicium 24 forms a continuum between two perpendicular planes, a first plane corresponding to the end 20 of the product 10 and a second plane corresponding to the XY plane defined by and tangent to the end 20 of the product 10 at any particular point. This arrangement allows for coordination of the indicia 24 throughout the entire product 10.

In yet another embodiment, the functional or aesthetic indicia 24 may wrap the end 20 of the spiral wound paper product 10 from the XY surface to the inner circumference of the core 14 or to the inner circumference of the innermost sheet if a coreless embodiment is selected. This arrangement provides for a further continuum of aesthetic indicia 24. This arrangement may also be used to provide for a dry-strength resin to be applied to the core 14 if a functional indicia 24 is selected.

If it is desired to print indicia 24 on the XY surface of the spiral wound product 10, the prior art teaches repeating patterns occurring at a frequency of less than 1 centimeter to greater than 1 meter. However, the indicia 24 may be nonrepeating throughout the length of the spiral wound paper product 10. The length of the spiral wound paper product 10 may vary from 15 meters or less to 36 meters or more. By having a nonrepeating pattern throughout the length of the paper product 10, consumer anticipation for new aesthetic indicia 24 may build during the life of the product 10.

If desired, the indicia 24 may be functional in addition to or instead of providing an aesthetic benefit. By functional, it is meant that the indicia 24 performs a useful function not limited to being visually discernible. Referring to FIG. 1, the ends 20 of the paper product 10 may be marked so that the consumer knows when a particular number of sheets (or amount of indeterminate length product 10) is left before the product 10 is exhausted. For example, the ends 20 of the last few (e.g., three or seven) sheets may be provided with a differently colored indicium 24.

Alternatively, one or both ends 20 of the spiral wound product 10 may be provided with radial sheet count indicia 24. The radial sheet count indicia 24 provides an ongoing monitor of the number of sheets left before the product 10 is exhausted. This is particularly beneficial since spiral wound product 10 life is a nonlinear function of the diameter. A plurality of radial indicia 24 may be disposed on either or both ends 20 of the spiral wound product 10.

Furthermore, the indicia 24 may provide for adhesive contact of the transverse edges of each sheet relative to a radially adjacent sheet. The adhesive provides the benefit of reduced telescoping or coning during winding, shipment and handling. Additionally, the adhesive applied to the ends 20 of the product 10 would prevent undesirable unwinding of a spiral wound paper product 10 dispensed from a vertical axis dispenser. Such an arrangement retains the benefit that less adhesive is necessary to achieve the benefits of the claimed invention, reducing manufacturing cost while still allowing the paper product 10 to remain soft and absorbent. Furthermore, an adhesive functional indicium 24 prophetically obviates the need for and expense of a tail seal on the free end of the outermost sheet of the spiral wound product 10. Alternatively, the functional indicia 24 may comprise microencapsulation or other means to provide a scent which is activated upon dispensing.

Furthermore, the functional indicia 24 may provide for increased absorption of the product 10. Particularly, absorbent gelling materials (also known as superabsorbents, hydrogel material, absorbent polymer) may be disposed on the edges of the product 10. Particulate absorbent gelling materials may be adhesively joined to the end 20 of the product 10 or may be applied as an aqueous dispersion. This arrangement provides a damming effect should the absorbent capacity of the product 10 become overloaded while in use. If desired, only two oppositely disposed sides, two adjacent sides, or all four sides of a rectangularly shaped product 10 provided in discrete sheet form may have the functional indicia, such as the absorbent gelling material, disposed thereon. Exemplary absorbent gelling materials include Nalco 1180 available from Stockhausen, Inc. of Greensboro, N.C. and ASAP 2300 available from Chemdal, Corp. of Palatine, Ill.

If desired, the absorbent gelling material may be printed on and in situ polymerized. A suitable technique for accomplishing such an application of the absorbent gelling material, or other appropriate functional indicia, to the ends 20 of the product 10 is disclosed in commonly assigned U.S. Pat. No. 5,487,736, issued Jan. 30, 1996 to Phan; U.S. Pat. No. 5,547,747, issued Aug. 20, 1996 to Trokhan et al.; U.S. Pat. No. 5,549,928, issued Aug. 27, 1996 to Trokhan et al.; and U.S. Pat. No. 5,840,403, issued Nov. 24, 1998 to Trokhan et al., all incorporated herein by reference.

In an alternative embodiment, the dispensable product 10 may be provided in a cut-and-stack configuration. In a cut-and-stack configuration the dispensable product 10 is disposed in a package and dispensed therefrom through an opening. The opening may be disposed on one or more faces of the package. The consumer may either reach into the opening of the package to dispense the product 10 therefrom, or dispense the product 10 in a pop-up mode.

Examining the package in more detail, the package may be rigid or flaccid. If the package is flaccid, it may be made in accordance with commonly assigned PCT application No. 98138105 filed Feb. 28, 1997 in the names of Hill, et al.; U.S. Pat. No. 4,886,167 issued Dec. 12, 1989 to Dearwester; U.S. Pat. No. 5,027,582 issued Jul. 2, 1991 to Dearwester; U.S. Pat. No. 5,379,897 issued Jan. 10, 1995 to Muckenfuhs; U.S. Pat. No. 5,685,428 issued Nov. 11, 1997 to Herbers, et al.; U.S. Pat. No. 5,735,106 issued Apr. 7, 1998 to Burda, et al., which are incorporated herein by reference.

If a rigid package is desired, it may be made in accordance with commonly assigned PCT application No. 98 18682 filed Oct. 29, 1996 in the name of Umanetz; U.S. 3,576,243 issued Apr. 27, 1971, to Truinck; U.S. Pat. No. 3,881,632 issued May 6, 1975 to Early, et al.; U.S. Pat. No. 4,231,491 issued Nov. 4, 1980 to Pierson, et al.; U.S. Pat. No. 4,197,964 issued Apr. 15, 1980 to Pryor; U.S. Pat. No. 4,623,074 issued Nov. 18, 1986 to Dearwester; U.S. Pat. No. 4,765,508 issued Aug. 23, 1988 to Poppe; U.S. Pat. No. 5,332,118 issued Jul. 26, 1994 to Muckenfuhs; U.S. Pat. No. 5,520,308 issued May 28, 1996 to Berg, et al.; U.S. Pat. No. 5,516,001 issued May 14, 1996 to Muckenfuhs, et al.; U.S. Pat. No. 5,520,308 issued May 28, 1996 to Berg, Jr., et al.; U.S. Pat. No. 5,535,887 issued Jul. 16, 1996 to Young, et al.; U.S. Pat. No. 5,618,008 issued Apr. 8, 1997 to Dearwester; U.S. Pat. No. 5,810,200 issued Sep. 22, 1998 to Trokhan; and PCT application No. 98 29108 filed Dec. 30, 1996 in the names of Brewer, et al., which are incorporated herein by reference.

If desired, the package may be provided with transparent windows. This allows aesthetic indicia 24 disposed on the ends 20 of the dispensable product 10 disposed in the package to be visible through the windows of the package. Typically, such products 10 are disposed in a parallelelpidedally-shaped package having two pairs of oppositely-disposed ends 20 arranged in a rectangular cross-section. One pair of oppositely-disposed ends 20 may be provided with the indicia 24, both pairs may be so provided, or adjacent ends 20 perpendicularly disposed relative to each other may be provided with the indicia 24.

This arrangement provides the advantage that a single package may be used for multiple clips of the dispensable paper product 10. The package may be generically marked. However, each clip of the dispensable product 10, particularly facial tissues and the like, may be provided with different aesthetic indicia 24 on the ends 20. The aesthetic indicia 24 would then be visible through the transparent windows and selected by the consumers according to their tastes.

Alternatively, the cut-and-stack arranged dispensable product 10 may be provided with a functional indicium 24 disposed on one or more ends 20 of the product 10 as described above. One prophetically suitable functional indicium 24 comprises adhesive. The adhesive, properly disposed on the ends 20 of the product 10, may allow for pop-up dispensing of sequential sheets of the dispensable product 10. For example, successive facial tissues could prophetically be dispensed in the pop-up mode if adhesively joined together at the edges. A suitable adhesive is supplied by the Findley Adhesives Inc. of Wauwatosa, Wis. as H9087-05, although it is envisioned that a variety of hot melt and pressure-sensitive adhesives would be suitable as known in the art. This arrangement provides the benefit of pop-up dispensing without the expense of interleaving adjacent sheets of tissue or other dispensable products 10 provided in discrete sheet form.

Various embodiments and individual features are disclosed in the description of the invention. All combinations of such embodiments and features are possible and can result in preferred executions of the invention.

What is claimed is:

1. A dispensable product, said dispensable product comprising a substrate, said substrate defining an XY plane and being arranged in a packagable configuration wherein said substrate is divisible into individual sheets and disposed in a cut and stack configuration, said packagable configuration having a dispensing direction in which a portion of said substrate may be removed from the balance of said product, said dispensable product having two oppositely-disposed ends, said two ends being a first and a second end, at least one of said first and second ends having a vector component oriented generally perpendicular to said dispensing direction, at least one of said first and second ends having indicia disposed thereon wherein said indicia comprise a functional indicia and whereby said indicia form a continuous pattern throughout at least one of said first and second ends and wherein said indicia comprise absorbent gelling material.

2. A spiral wound product comprising a substrate said substrate forming a generally cylindrical configuration having two oppositely-disposed ends, wherein said indicia forms a continuous pattern throughout at least one of said first and second ends, at least one of said ends having indicia disposed thereon and wherein said substrate defines an XY plane, the XY plane of said substrate further comprising indicia thereon wherein said indicia comprises aesthetic indicia and wherein said aesthetic indicia wrap from the XY plane of said substrate to the end of said product and wherein said indicia is ink, absorbent gelling material, or mixtures thereof and wherein said spiral wound product further comprises a core, said substrate being wound around said core, and wherein said indicia further wrap from the ends of said product to the inner circumference of said core.

* * * * *